US012350597B2

(12) United States Patent
Jiang

(10) Patent No.: US 12,350,597 B2
(45) Date of Patent: Jul. 8, 2025

(54) SMART MAGIC CUBE WITH BALL SHAFT

(71) Applicant: GUANGZHOU GANYUAN INTELLIGENT TECHNOLOGY CO., LTD., Guangzhou (CN)

(72) Inventor: Ganyuan Jiang, Guangzhou (CN)

(73) Assignee: GUANGZHOU GANYUAN INTELLIGENT TECHNOLOGY CO., LTD., Guangzhou (CN)

( * ) Notice: Subject to any disclaimer, the term of this patent is extended or adjusted under 35 U.S.C. 154(b) by 322 days.

(21) Appl. No.: 18/115,770

(22) Filed: Mar. 1, 2023

(65) Prior Publication Data

US 2024/0123329 A1 Apr. 18, 2024

(30) Foreign Application Priority Data

Oct. 18, 2022 (CN) ..... 202211274795.6

(51) Int. Cl.
*A63F 9/08* (2006.01)
*A63F 9/06* (2006.01)

(52) U.S. Cl.
CPC ..... *A63F 9/0842* (2013.01); *A63F 9/0612* (2013.01)

(58) Field of Classification Search
CPC ..... A63F 9/0842; A63F 9/0612; A63F 9/08
See application file for complete search history.

(56) References Cited

U.S. PATENT DOCUMENTS

| | | | | |
|---|---|---|---|---|
| 11,779,833 | B1 * | 10/2023 | Teel | A63F 9/0612 |
| 2022/0072414 | A1 * | 3/2022 | Su | A63F 9/0838 |
| 2023/0080489 | A1 * | 3/2023 | Dor | A63F 13/211 463/9 |

* cited by examiner

*Primary Examiner* — James S. McClellan
(74) *Attorney, Agent, or Firm* — Muncy, Geissler, Olds & Lowe, P.C.

(57) ABSTRACT

A smart magic cube with a ball shaft includes the ball shaft, six center blocks, eight corner blocks fitted with the center blocks, and twelve edge blocks fitted with the corner blocks and the center blocks. The center blocks are respectively arranged on a rotating shaft sensing assembly of the ball shaft. The smart magic cube with the ball shaft has a, clever design. Six printed circuit boards consist an electronic control system of the ball shaft. With each rotating shaft sensing assembly installed on each of the printed circuit boards, position sensing of the smart magic cube is accurate and a rate of lost steps of the smart magic cube is reduced. Further, the smart magic cube is not assembled by wire welding, has high integration, has a low cost, and is easy to assemble.

7 Claims, 11 Drawing Sheets

SMART MAGIC CUBE WITH BALL SHAFT

TECHNICAL FIELD

The present disclosure relates to a technical field of magic cubes, and in particular to a smart magic cube with a ball shaft.

BACKGROUND

A magic cube in the prior art is a cube made of flexible hard plastic. The magic cube comprises a shaft arranged in a center thereof and 26 blocks. The 26 blocks comprise six center blocks, eight corner blocks, and twelve edge blocks, each of which is colored on one side only. The six center blocks are fixed, and the corner blocks and the edge blocks are rotatable. When the magic cube is sold, the 26 blocks are arranged so that the blocks arranged on a same side have a same color. When the blocks arranged on one side of the magic cube are rotated, the blocks on adjacent sides would not be in the same color, and a new pattern of the magic cube is formed. The magic cube may be rotated again and again to form different patterns, and each side of the magic cube comprises blocks in different colors. The magic cube is played by rotating the blocks of disrupted colors as quickly as possible, so that the blocks of the same color are arranged on the same side.

Complex magic cubes, as competition props, are used in magic cube competitions. During a competition, players need to rotate the magic cube quickly to complete reordering of the magic cube in the shortest time. A conventional magic cube, which relies on player's precise rotation, must be rotated 90 degrees each time or the magic cube is easily stuck. Therefore, a magnetic positioning magic cube is created in response to the proper time and conditions. Magnetic force makes the magnetic positioning magic cube to be positioned accurately in 90 degrees when rotating.

However, conventional smart magic cubes have following defects:

Because of numerous electronic accessories and plastic parts, the conventional smart magic cubes have heavy weight, complex process, super high cost, and inaccurate position sensing, so the conventional smart magic cubes may not rotate to a predetermined position when the players rotate the conventional smart magic cubes, which affects a recovery speed and a recovery success rate, and affects player experience.

In the conventional magic cubes, a face position coding sensor is installed in a center cover, while the center cover do not have GES mechanical feel, has a complex structure, has a high cost, and can not be repaired.

The conventional magic cubes are assembled by wire welding, FPC flat wire welding, making a wire layout messy, and resulting in high welding costs and high quality risk.

SUMMARY

In view of defects in the prior art, the present disclosure proposes a smart magic cube with a ball shaft having a smart structural design. Six printed circuit boards consist an electronic control system of the ball shaft. With a rotating shaft sensing assembly installed on each of the printed circuit boards, position sensing of the smart magic cube is accurate and a rate of lost steps of the smart magic cube is reduced. Further, the smart magic cube is not assembled by wire welding, has a high integration, has a low cost, and is easy to assemble.

To realize above objects, the present disclosure provides the smart magic cube with the ball shaft.

The smart magic cube with the ball shaft comprises the ball shaft, six center blocks, eight corner blocks fitted with the center blocks, and twelve edge blocks fitted with the corner blocks and the center blocks.

The ball shaft comprises a ball shaft upper cover and a ball shaft lower cover. The ball shaft upper cover and the ball shaft lower cover are hemispherical. The ball shaft lower cover and ball shaft upper cover are assembled into a sphere. An upper fixing mounting seat is arranged in the ball shaft upper cover and a lower fixing mounting seat is arranged in the ball shaft lower cover. A front printed circuit board (PCB), a rear PCB, a left PCB, and a right PCB are embedded between the upper fixing mounting seat and the lower fixing mounting seat. An upper PCB is fixed on the upper fixing mounting seat and a lower PCB is fixed on the lower fixing mounting seat.

The front PCB, the rear PCB, the left PCB, and the right PCB are respectively electrically connected to the upper PCB and lower PCB through connecting plugs. A center processing unit (CPU) is fixedly installed on the lower PCB. A battery is installed between the upper fixing mounting seat and the lower fixing mounting seat. The battery is connected to the upper PCB through a battery conductive sheet. A wireless BLUETOOTH module is installed on the upper PCB. A rotating shaft sensing assembly is arranged on each of the upper PCB, the lower PCB, the front PCB, the rear PCB, the left PCB, and the right PCB. Each rotating shaft sensing assembly extends outward to an outer side of the ball shaft lower cover or an outer side of the ball shaft upper cover. Each of the center blocks is installed on a corresponding rotating shaft sensing assembly.

In the embodiment, during actual use, when any one of six sides of the smart magic cube is rotated 90 degrees, a corresponding rotating shaft sensing assembly is made to rotate 90°, generating a 90° displacement sensing signal at a time, and the CPU records the operation. Once the smart magic cube is rotated, the operation is recorded by the CPU and recorded information is transmitted in real time to a corresponding application (APP) for recording through the wireless BLUETOOTH module. When the smart magic cube needs to be recovered, a corresponding instruction is sent through the corresponding APP, and the CPU repeats recorded operations until the smart magic cube is recovered, which realizes smart restoration of the smart magic cube. Each of the recorded operations is recorded in the corresponding APP to improve a fun of an operation of the smart magic cube. When assembling the ball shaft, the front PCB, the rear PCB, the left PCB, and the right PCB are embedded between the upper fixing mounting seat and the lower fixing mounting seat, and then the upper PCB and the lower PCB are respectively fixed on the upper fixing mounting seat and the lower fixing mounting seat. The battery conductive sheet provides power to the upper PCB and each of the PCBs is interconnected with power and signal through the connecting plugs, so no wire welding is required. The smart magic cube is highly integrated, is low cost, and is easy to install. Further, the smart magic cube is able to process information collected by each of the PCBs through the CPU installed on the lower PCB and make corresponding feedback.

Optionally, each rotating shaft sensing assembly comprises a rotating shaft, a rotating shaft sleeve, and a position sensor. Each position sensor is correspondingly installed in a position sensor mounting groove. Each position sensor mounting groove is defined in a center of the upper PCB, a center of the lower PCB, a center of the front PCB, a center of the rear PCB, a center of the left PCB, or a center of the right PCB. Each rotating shaft is fixed on a corresponding PCB through a corresponding rotating shaft sleeve. A bottom end of each rotating shaft is connected to a corresponding position sensor. In actual use, when one rotating shaft rotates, a corresponding position sensor rotates along with the one rotating shaft and then transmits a displacement signal to the CPU for recording through a corresponding PCB to facilitate a subsequent recovery of the smart magic cube.

Optionally, each of the center blocks comprises a center block seat sleeved on a corresponding rotating shaft. A spring seat is installed in each center block seat. An elastic adjusting spring is sleeved on each rotating shaft. A bottom end of each elastic adjusting spring abuts against a corresponding center block seat. Atop end of each elastic adjusting spring abuts against a corresponding spring seat. An elastic gear adjusting block is installed on a top portion of each spring seat. A gear dial is installed on a top portion of each elastic gear adjusting block. Each rotating shaft longitudinally passes through a center of a corresponding elastic adjusting spring, a center of a corresponding spring seat, a center of a corresponding elastic gear adjusting block, and a center of a corresponding gear dial, and is clamped with the corresponding gear dial. A top cover covers a top portion of each center block seat.

In actual use, when it is necessary to adjust elasticity of one of the center blocks, a corresponding top cover is simply removed, and then a corresponding gear dial is dialed. Through cooperation between the corresponding gear dial and a corresponding elastic gear adjusting block, pressure of a corresponding spring seat on a corresponding elastic adjusting spring is adjusted. The greater the pressure between each center block seat and a corresponding rotating shaft, the greater a force required to rotate the smart magic cube. On the contrary, the smaller the pressure between each center block seat and the corresponding rotating shaft, the smaller the force required to rotate the smart magic cube, The smart magic cube may be adjusted according to actual needs of an operator to adjust each gear dial, so the smart magic cube meet needs of different operators.

Optionally, each of the corner blocks comprises a corner block seat. Three corner block magnetic bins are evenly arranged on sides of each corner block seat. A first magnet is installed in each of the corner block magnetic bins. Atop portion of each corner block seat is sealed by three corner block pressing covers connected with each other. The three corner block magnetic bins are evenly arranged on the sides of each corner block seat, and each first magnet is installed in a corresponding corner block magnetic bin, so that each first magnet is matched with a corresponding second magnet arranged on one side of a corresponding edge block. The magnetic force enables the smart magic cube to be positioned by the magnetic force as a six-sided cube body, making positioning of the smart magic cube accurate.

Optionally, each of the edge blocks comprises an edge block seat. Two edge block magnetic bins are symmetrically arranged on two sides of each edge block seat. A second magnet is installed in each of the edge block magnetic bins. A top portion of each edge block seat is sealed by two edge block pressing covers connected with each other. Each second magnet installed in a corresponding edge block magnetic bin is connected with a corresponding first magnet installed in a corresponding corner block magnetic bin by the magnetic force, so that the positioning and movement of the smart magic cube is accurate when the edge blocks and the corner blocks rotate.

Optionally, the ball shaft lower cover comprises a lower cover body in a hemispherical shape. A bottom rotating shaft hole is defined on a bottom portion of the lower cover body. Four side rotating shaft lower half holes are defined on a top end of the lower cover body. A plurality of screw posts is defined on the lower cover body. When assembling, each rotating shaft in each rotating shaft sensing assembly passes through the bottom rotating shaft hole or a corresponding side rotating shaft lower half hole to limit each rotating shaft.

Optionally, the ball shaft upper cover comprises a upper cover body in a hemispherical shape. A top rotating shaft hole is defined on a top portion of the upper cover body. Four side rotating shaft upper half holes are defined on a bottom end of the upper cover body. The four side rotating shaft upper half holes are matched with the four side rotating shaft lower half holes. Screw grooves are defined on an outer surface of the upper cover body. Each of the screw grooves defines a docking screw hole matching a corresponding screw post defined on the lower cover body. Each docking screw hole is connected with each of the screw posts through a screw to connect the ball shaft upper cover with the ball shaft lower cover, which realizes quick docking between the ball shaft upper cover with the ball shaft lower cover.

In the present disclosure, the smart magic cube with the ball shaft has simple structure, clever design and high integration, and is smart. The six printed circuit boards consist the electronic control system of the ball shaft. With each rotating shaft sensing assembly installed on each of the printed circuit boards, position sensing of the smart magic cube is accurate and the rate of lost steps of the smart magic cube is reduced. Further, the smart magic cube is no need to be assembled by wire welding, has high integration, has a low cost, and is easy to assemble. When assembling the ball shaft, the front PCB, the rear PCB, the left PCB, and the right PCB are embedded between the upper fixing mounting seat and the lower fixing mounting seat, and then the upper PCB and the lower PCB are respectively fixed on the upper fixing mounting seat and the lower fixing mounting seat. The battery conductive sheet provides power to the upper PCB and each of the PCBs is interconnected with power and signal through the connecting plugs, so no wire welding is required. The smart magic cube is highly integrated, is low cost, and is easy to install. Further, the smart magic cube is able to process information collected by each of the PCBs through the CPU installed on the lower PCB and make corresponding feedback.

The smart magic cube with the ball shaft is highly intelligent and interesting. During actual use, when any one of the six sides of the smart magic cube is rotated 90 degrees, the corresponding rotating shaft sensing assembly is made to rotate 90°, generating the 90° displacement sensing signal at a time, and the CPU records the operation. Once the smart magic cube is rotated, the operation is recorded by the CPU and recorded information is transmitted in real time to the corresponding APP for recording through the wireless BLUETOOTH module. When the smart magic cube needs to be recovered, the corresponding instruction is sent through the corresponding APP, and the CPU repeats recorded operations until the smart magic cube is recovered, which realizes smart restoration of the smart magic cube. Each of the recorded operations is recorded in the corresponding APP to improve the fun of the operation of the smart magic cube.

The elasticity of the smart magic cube with the ball shaft is adjustable and is easy to adjust. In actual use, when it is necessary to adjust elasticity of one of the center blocks, the corresponding top cover is simply removed, and then the corresponding gear dial is dialed. Through cooperation between the corresponding gear dial and the corresponding elastic gear adjusting block, the pressure of the corresponding spring seat on the corresponding elastic adjusting spring is adjusted, and thus the pressure between each enter block seat and the corresponding rotating shaft. The greater the pressure between each center block seat and the corresponding rotating shaft, the greater the force required to rotate the smart magic cube. On the contrary, the smaller the pressure between each center block seat and the corresponding rotating shaft, the smaller the force required to rotate the smart magic cube. The smart magic cube may be adjusted according to actual needs of the operator to adjust each gear dial, so the smart magic cube meet needs of different operators.

1—center block; 11—center block seat; 12—elastic adjusting spring; 13—spring seat; 14—elastic gear adjusting block; 15—gear dial; 16—top cover.

2—corner block; 21—corner block seat; 22—corner block pressing cover; 23—corner block magnetic bin; 24—first magnet/second magnet.

3—edge block; 31—edge block seat; 32—edge block pressing cover; 33—edge block magnetic bin.

4—ball shaft; 41—ball shaft lower cover; 4101—lower cover body; 4102—bottom rotating shaft hole; 4103—side rotating shaft lower half hole; 4104—screw post; 42—ball shaft upper cover; 4201—upper cover body; 4202—screw groove; 4203—docking screw hole; 4204—top rotating shaft hole; 4205—side rotating shaft upper half hole; 43—rotating shaft sensing assembly; 431—rotating shaft; 432—rotating shaft sleeve; 433—position sensor; 44—upper fixing mounting seat; 45—lower fixing mounting seat; 46—upper PCB; 47—lower PCB; 48—front/rear/left/right PCB; 49—connecting plug; 410—battery conductive sheet; 411—battery; 412—CPU; 413—wireless BLUETOOTH module.

DETAILED DESCRIPTION

Technical solutions in the embodiments of the present disclosure will be clearly and completely described below in conjunction with the accompanying drawings in the embodiments of the present disclosure. Obviously, the described embodiments are only a part of the embodiments of the present disclosure, rather than all of the embodiments. Based on the embodiments of the present disclosure, all other embodiments obtained by those of ordinary skill in the art without creative work shall fall within the protection scope of the present disclosure.

Figure 1:
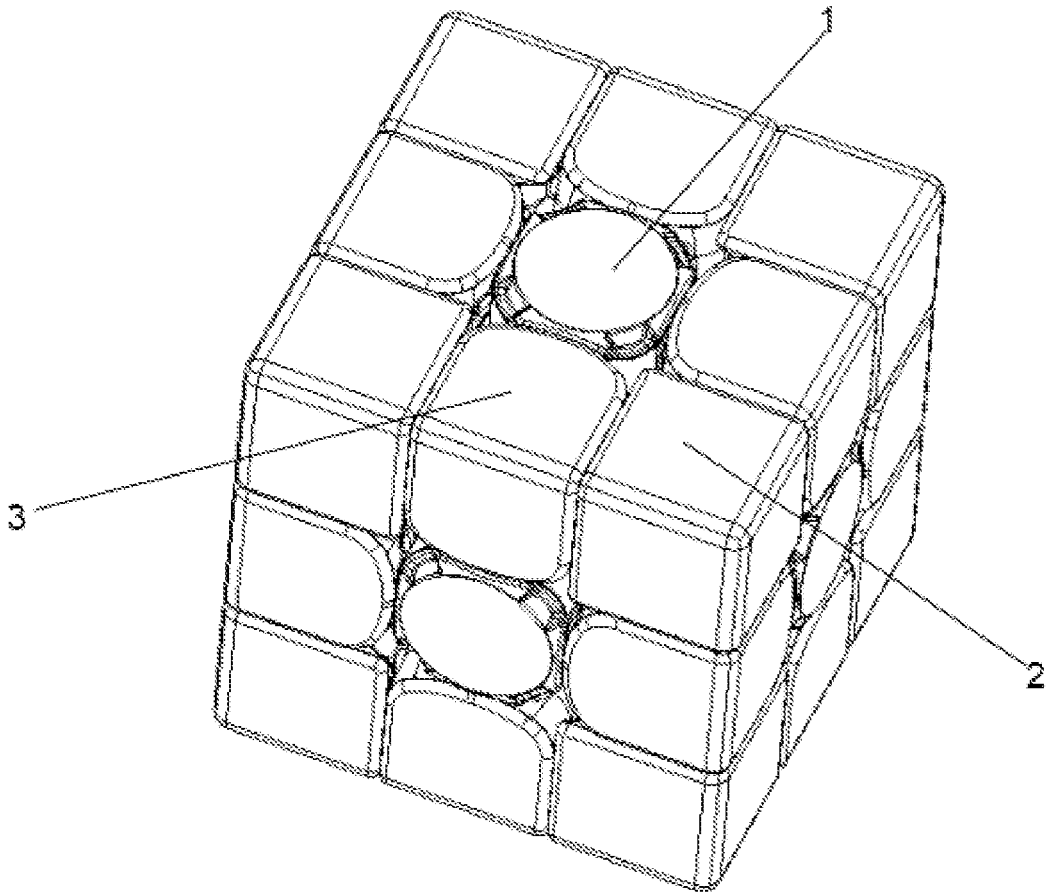
FIG. 1 is a perspective schematic diagram of a smart magic cube with a ball shaft of the present disclosure.
Figure 2:
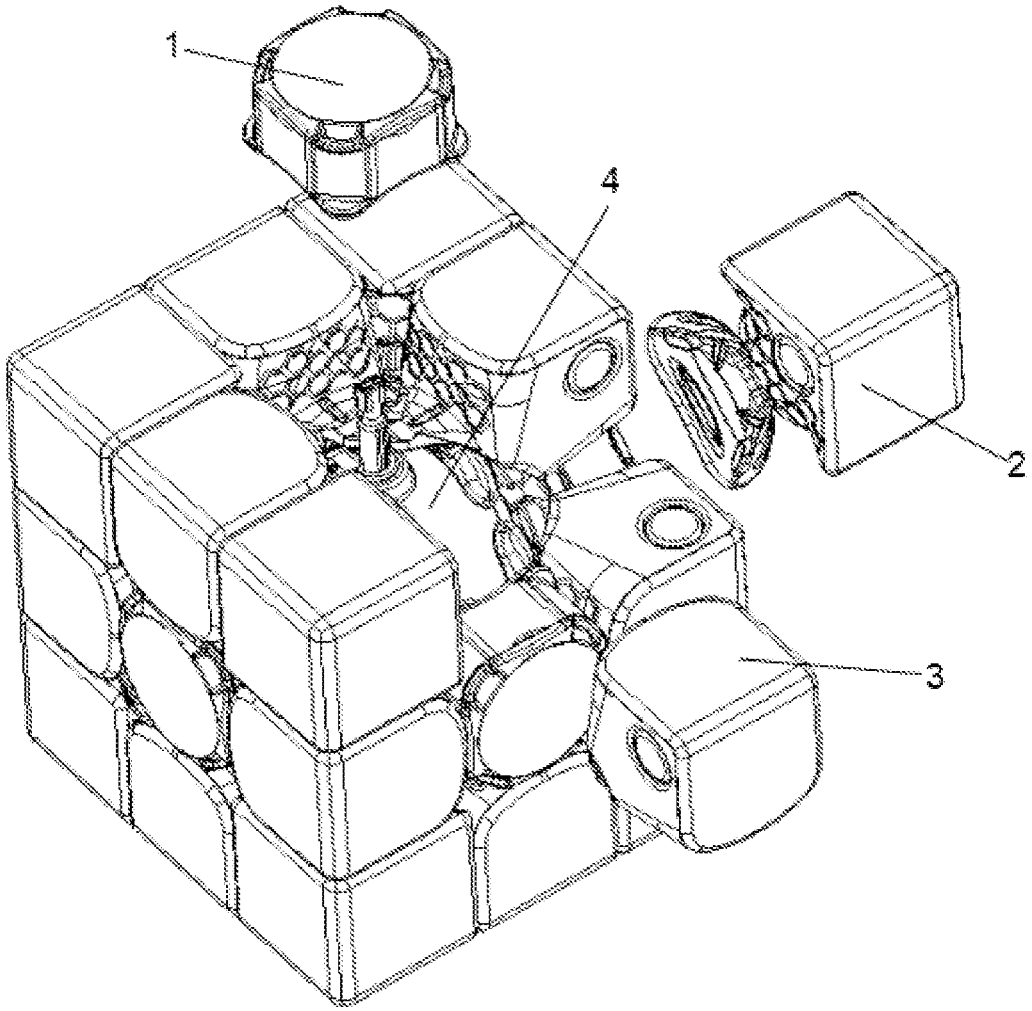
FIG. 2 is an exploded perspective schematic diagram of the smart magic cube with the ball shaft of the present disclosure.
Figure 3:
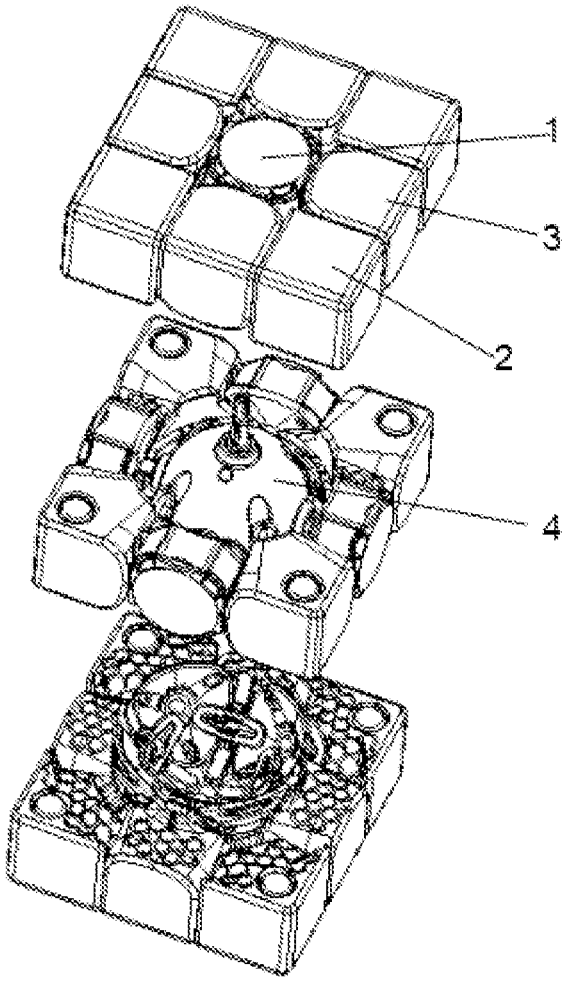
FIG. 3 is another exploded perspective schematic diagram of the smart magic cube with the ball shaft of the present disclosure.
Figure 4:
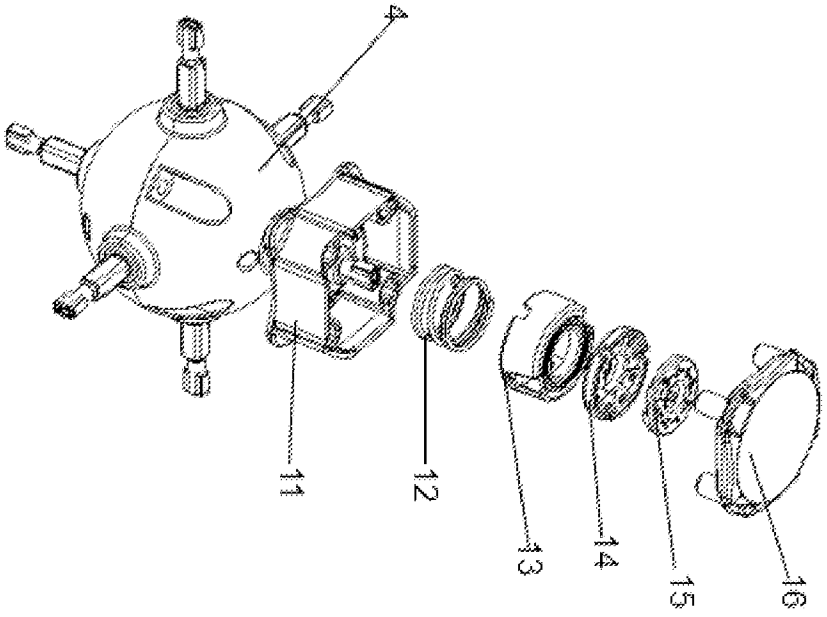
FIG. 4 is an exploded perspective schematic diagram of the ball shaft and a center block of the present disclosure.
Figure 5:
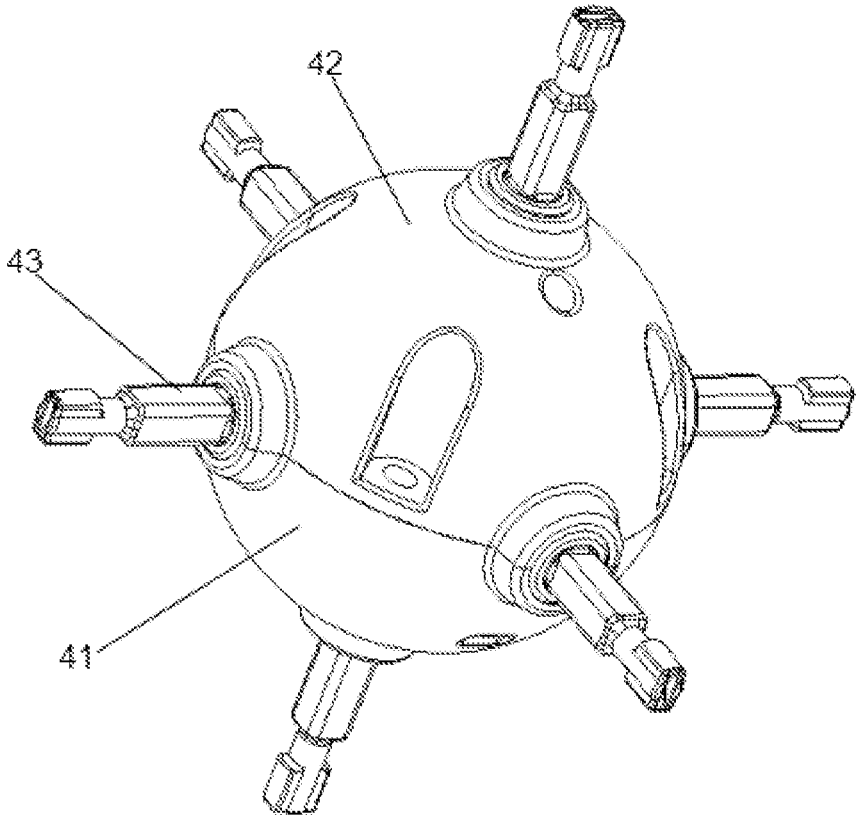
FIG. 5 is a perspective schematic diagram of the ball shaft of the present disclosure.
Figure 6:
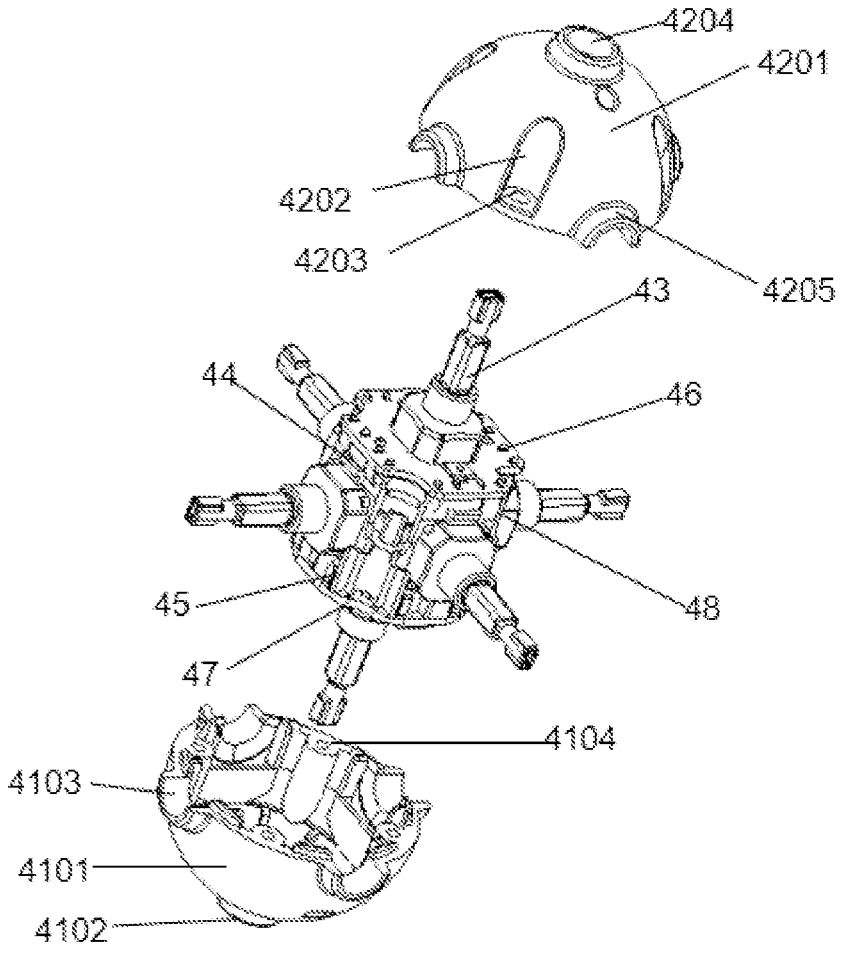
FIG. 6 is an exploded perspective schematic diagram of the ball shaft of the present disclosure.
Figure 7:
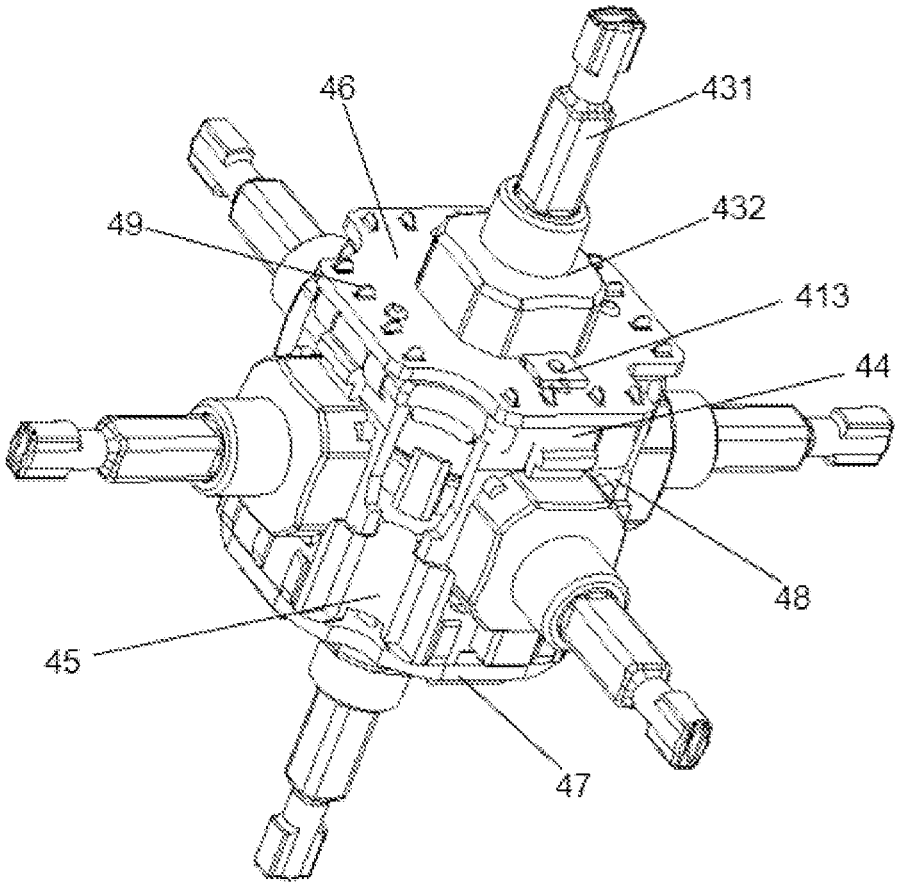
FIG. 7 is another exploded perspective schematic diagram of the ball shaft of the present disclosure.
Figure 8:
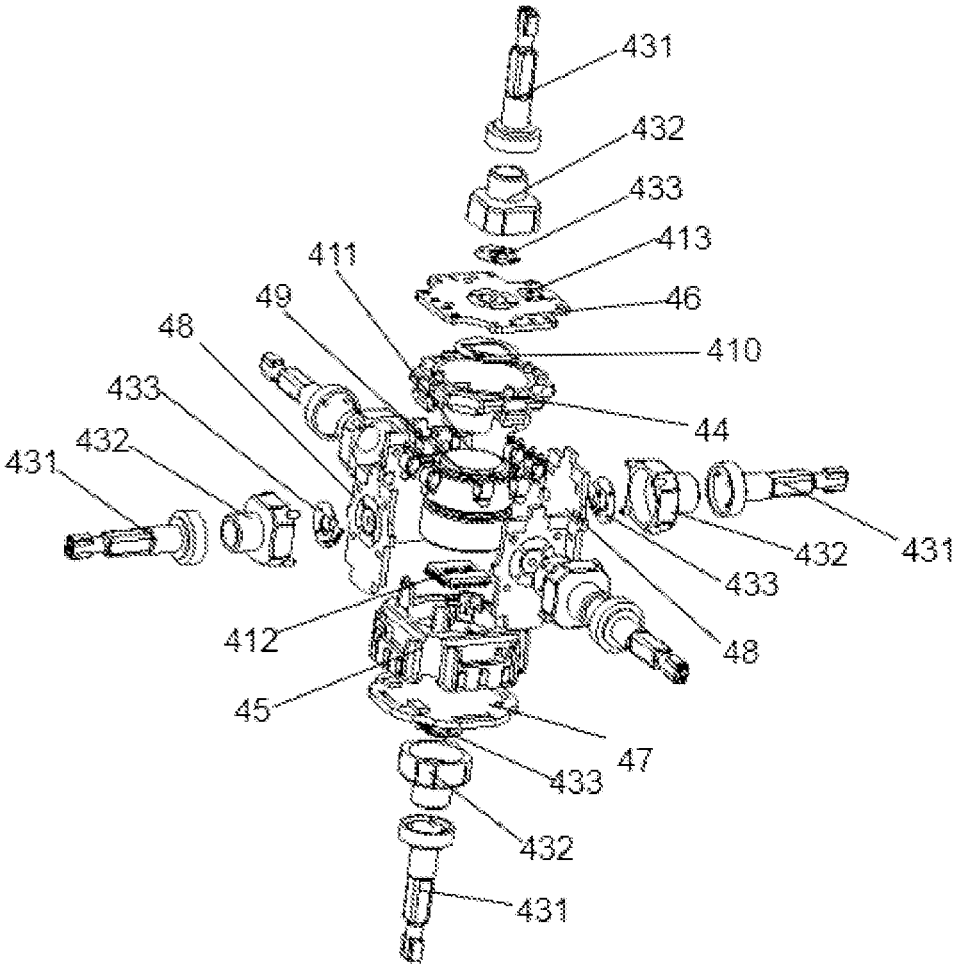
FIG. 8 is another exploded perspective schematic diagram of the ball shaft of the present disclosure.
Figure 9:
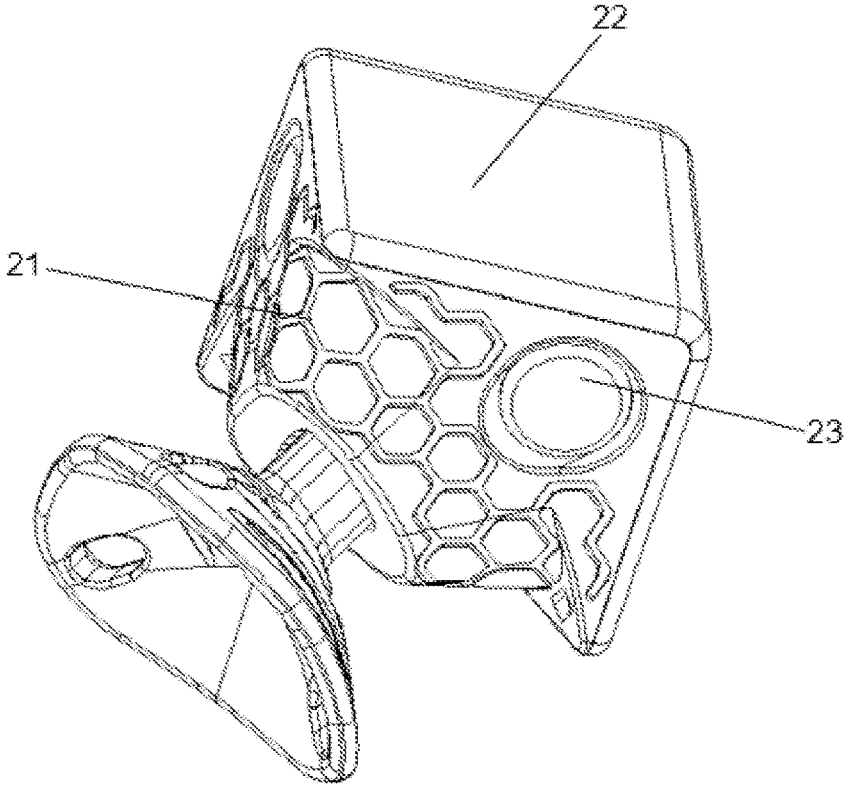
FIG. 9 is a perspective schematic diagram of a corner block of the present disclosure.
Figure 10:
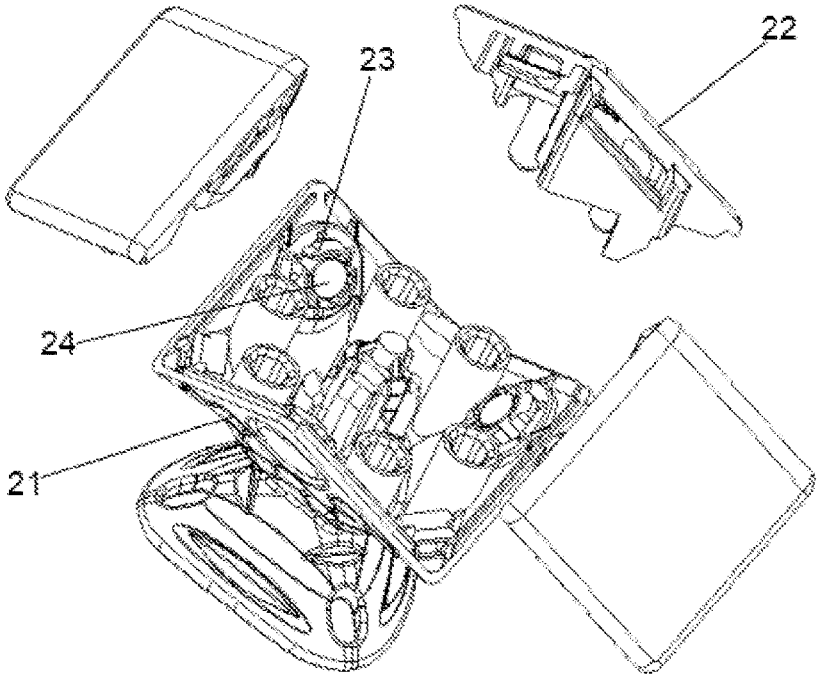
FIG. 10 is an exploded perspective schematic diagram of the corner block of the present disclosure.
Figure 11:
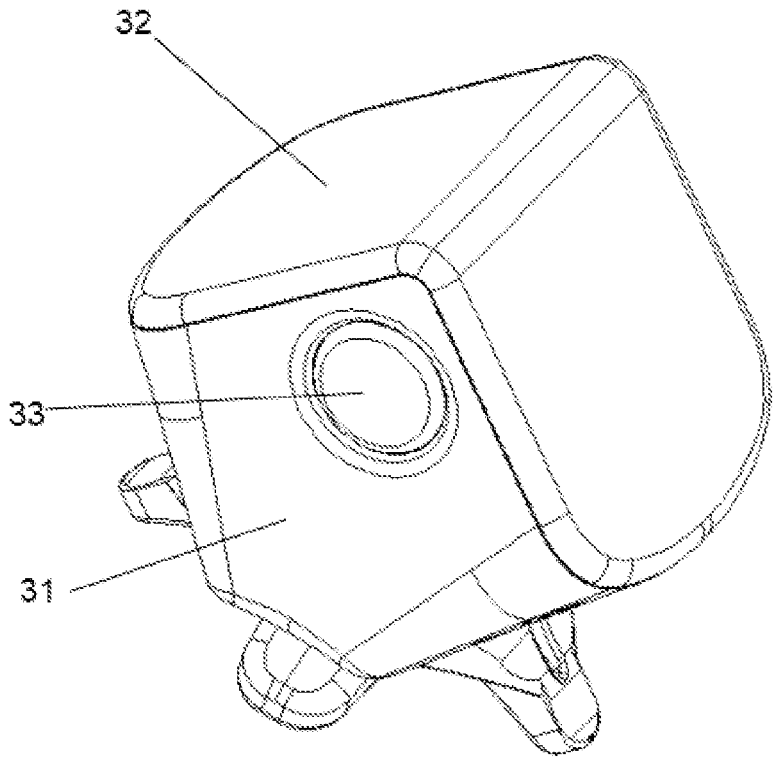
FIG. 11 is a perspective schematic diagram of an edge block of the present disclosure.
Figure 12:
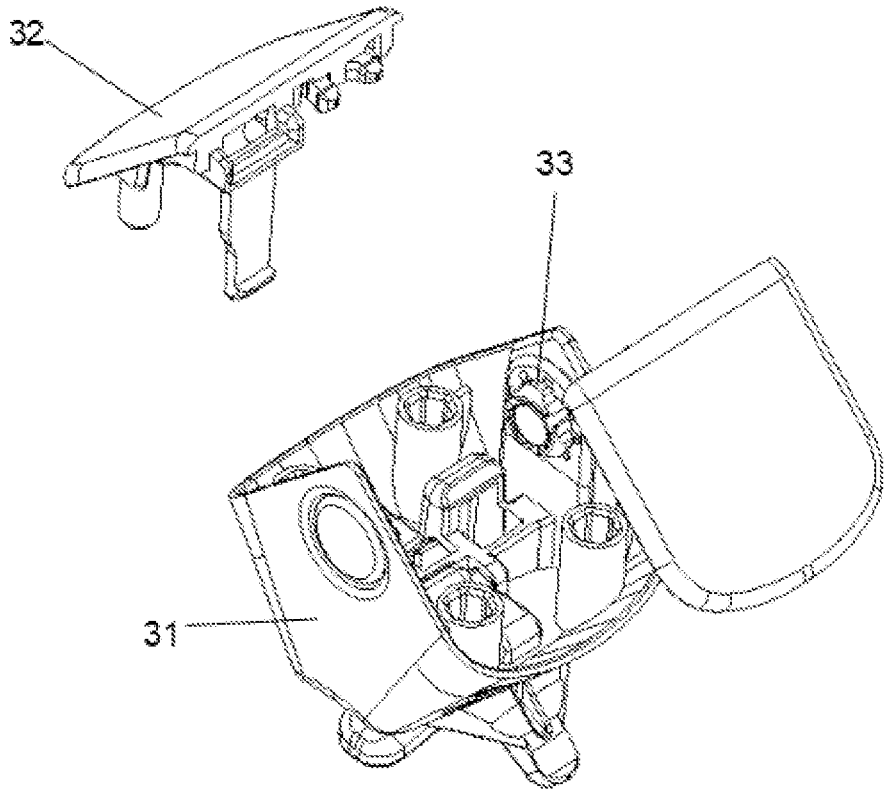
FIG. 12 is an exploded perspective schematic diagram of the edge block of the present disclosure.

As shown in FIGS. 1-12, the present disclosure provides a smart magic cube with a ball shaft.

The smart magic cube with the ball shaft comprises the ball shaft 4, six center blocks 1, eight corner blocks 2 fitted with the center blocks 1; and twelve edge blocks 3 fitted with the corner blocks 2 and the center blocks 1.

The ball shaft 4 comprises a ball shaft upper cover 42 and a ball shaft lower cover 41. The ball shaft upper cover 42 and the ball shaft lower cover 41 are hemispherical. The ball shaft lower cover 41 and ball shaft upper cover 42 are assembled into a sphere. The ball shaft lower cover 41 comprises a lower cover body in a hemispherical shape. A bottom rotating shaft hole 4102 is defined on a bottom portion of the lower cover body 4101. Four side rotating shaft lower half holes 4103 are defined on a top end of the lower cover body 4101. A plurality of screw posts 4104 is defined on the lower cover body 4101. When assembling, each rotating shaft 431 in each rotating shaft sensing assembly passes through the bottom rotating shaft hole 4102 or a corresponding side rotating shaft lower half hole 4103 to limit each rotating shaft 431.

The ball shaft upper cover 42 comprises a upper cover body 4201 in a hemispherical shape. Atop rotating shaft hole 4204 is defined on a top portion of the upper cover body 4201. Four side rotating shaft upper half holes 4205 are defined on a bottom end of the upper cover body 4201. The four side rotating shaft upper half holes 4205 are matched with the four side rotating shaft lower half holes 4103. Screw grooves 4202 are defined on an outer surface of the upper cover body 4201. Each of the screw grooves 4202 defines a docking screw hole 4203 matching a corresponding screw post 4104 defined on the lower cover body 4201. Each docking screw hole 4203 is connected with each of the screw posts 4104 through a screw to connect the ball shaft upper cover 42 with the ball shaft lower cover 41, which realizes quick docking between the ball shaft upper cover with the ball shaft lower cover.

An upper fixing mounting seat 44 is arranged in the ball shaft upper cover 42 and a lower fixing mounting seat 45 is arranged in the ball shaft lower cover 41. A front printed circuit board (PCB) 48, a rear PCB 48, a left PCB 48, and a right PCB 48 are embedded between the upper fixing mounting seat 44 and the lower fixing mounting seat 45. An upper PCB 46 is fixed on the upper fixing mounting seat 44 and a lower PCB 47 is fixed on the lower fixing mounting seat 45. The front PCB 48, the rear PCB 48, the left PCB 48, and the right PCB 48 are respectively electrically connected to the upper PCB 46 and lower PCB 47 through connecting plugs 49. A center processing unit (CPU) 412 is fixedly installed on the lower PCB 47. A battery 411 is installed between the upper fixing mounting seat 44 and the lower fixing mounting seat 45. The battery 411 is connected to the upper PCB 46 through a battery conductive sheet 410. A wireless BLUETOOTH module 413 is installed on the upper PCB 46. A rotating shaft sensing assembly 43 is arranged on the upper PCB 46, the lower PCB 47, the front PCB 48, the rear PCB 48, the left PCB 48, and the right PCB 48. Each rotating shaft sensing assembly 43 extends outward to an outer side of the ball shaft lower cover 41 or an outer side of the ball shaft upper cover 42.

Each rotating shaft sensing assembly 43 comprises a rotating shaft 431, a rotating shaft sleeve 432, and a position sensor 433. Each position sensor 433 is correspondingly installed in a position sensor mounting groove. Each position sensor mounting groove is defined in a center of the upper PCB 46, a center of the lower PCB 47, a center of the front PCB 48, a center of the rear PCB 48, a center of the left PCB 48, or a center of the right PCB 48. Each rotating shaft 431 is fixed on a corresponding PCB through a corresponding rotating shaft sleeve 432. A bottom end of each rotating shaft 431 is connected to a corresponding position sensor 433. In actual use, when one rotating shaft 431 rotates, a corresponding position sensor 433 rotates along with the one rotating shaft 431 and then transmits a displacement signal to the CPU for recording through a corresponding PCB to facilitate a subsequent recovery of the smart magic cube.

The smart magic cube with the ball shaft is ingeniously designed, intelligent and highly integrated. The six printed circuit boards consist the electronic control system of the ball shaft. With each rotating shaft sensing assembly 43 installed on each of the printed circuit boards, position sensing of the smart magic cube is accurate and the rate of lost steps of the smart magic cube is reduced. Further, the smart magic cube is highly integrated, is simple to process, has a low cost, and is easy to assemble. When assembling the front PCB 48, the rear PCB 48, the left PCB 48, and the right PCB 48 are embedded between the upper fixing mounting seat 44 and the lower fixing mounting seat 45, and then the upper PCB 46 and the lower PCB 47 are respectively fixed on the upper fixing mounting seat 44 and the lower fixing mounting seat 45. The battery conductive sheet 410 provides power to the upper PCB 46 and each of the PCBs is interconnected with power and signal through the connecting plugs 49 Further, the smart magic cube is able to process information collected by each of the PCBs through the CPU 412 installed on the lower PCB 47 and make corresponding feedback.

Each of the center blocks 1 is installed on a corresponding rotating shaft sensing assembly 43 of the ball shaft 4. Each of the center blocks 1 comprises a center block seat 11 sleeved on a corresponding rotating shaft 431. A spring seat 13 is installed in each center block seat 11. An elastic adjusting spring 12 is sleeved on each rotating shaft 431. A bottom end of each elastic adjusting spring 12 abuts against a corresponding center block seat 11. A top end of each elastic adjusting spring 12 abuts against a corresponding spring seat 13. An elastic gear adjusting block 14 is installed on a top portion of each spring seat 13. A gear dial 15 is installed on a top portion of each elastic gear adjusting block 14. Each rotating shaft 431 longitudinally passes through a center of a corresponding elastic adjusting spring 12, a center of a corresponding spring seat 13, a center of a corresponding elastic gear adjusting block 14, and a center of a corresponding gear dial 15, and is clamped with the corresponding gear dial 15. Atop cover 16 covers a top portion of each center block seat 11.

In actual use, when it is necessary to adjust elasticity of one of the center blocks 1, a corresponding top cover 16 is simply removed, and then a corresponding gear dial 15 is dialed. Through cooperation between the corresponding gear dial 15 and a corresponding elastic gear adjusting block 14, pressure of a corresponding spring seat 13 on a corresponding elastic adjusting spring 12 is adjusted, thus pressure between the corresponding central block seat 11 and the corresponding rotating shaft 431 is adjusted. The greater the pressure between each center block seat 11 and the corresponding rotating shaft 431, the greater a force required to rotate the smart magic cube. On the contrary, the smaller the pressure between each center block seat 11 and the corresponding rotating shaft 431, the smaller the force required to rotate the smart magic cube, The smart magic cube may be adjusted according to actual needs of an operator to adjust each gear dial, so the smart magic cube meet needs of different operators.

Each of the corner blocks 2 comprises a corner block seat 21. Three corner block magnetic bins 23 are evenly arranged on sides of each corner block seat 31. A first magnet 24 is installed in each of the corner block magnetic bins 23. A top portion of each corner block seat 21 is sealed by three corner block pressing covers 22 connected with each other. The three corner block magnetic bins 23 are evenly arranged on the sides of each corner block seat 21, and each first magnet 24 is installed in a corresponding corner block magnetic bin 23, so that each first magnet 24 is matched with a corresponding second magnet arranged on one side of a corresponding edge block 3. The magnetic force enables the smart magic cube to be positioned by the magnetic force as a 90-degree cube body, making positioning of the smart magic cube accurate.

Each of the edge blocks 3 comprises an edge block seat 31. Two edge block magnetic bins 33 are symmetrically arranged on two sides of each edge block seat 31. A second magnet 24 is installed in each of the edge block magnetic bins 33. A top portion of each edge block seat 31 is sealed by two edge block pressing covers 32 connected with each other. Each second magnet 24 installed in a corresponding edge block magnetic bin 33 is connected with a corresponding first magnet 24 installed in a corresponding corner block magnetic bin 23 by the magnetic force, so that the positioning and movement of the smart magic cube is accurate when the edge blocks 3 and the corner blocks 2 rotate.

In the present disclosure, the smart magic cube with the ball shaft has simple structure, clever design and high integration, and is smart. The six printed circuit boards consist the electronic control system of the ball shaft. With each rotating shaft sensing assembly installed on each of the printed circuit boards, position sensing of the smart magic cube is accurate and the rate of lost steps of the smart magic cube is reduced. Further, the smart magic cube is not assembled by wire welding, has high integration, has a low cost, and is easy to assemble. When assembling the ball shaft, the front PCB 48, the rear PCB 48, the left PCB 48, and the right PCB 48 are embedded between the upper fixing mounting seat 44 and the lower fixing mounting seat 45, and then the upper PCB 46 and the lower PCB 47 are respectively fixed on the upper fixing mounting seat 44 and the lower fixing mounting seat 45. The battery conductive sheet 410 provides power to the upper PCB 46 and each of the PCBs is interconnected with power and signal through the connecting plugs 49. The smart magic cube is highly integrated, is low cost, and is easy to install. Further, the smart magic cube is able to process information collected by each of the PCBs through the CPU 412 installed on the lower PCB 47 and make corresponding feedback.

The smart magic cube with the ball shaft is highly intelligent and interesting. During actual use, when any one of the six sides of the smart magic cube is rotated 90 degrees, the corresponding rotating shaft sensing assembly is made to rotate 90°, generating the 90° displacement sensing signal at a time, and the CPU 412 records the operation. Once the smart magic cube is rotated, the operation is recorded by the CPU 412 and recorded information is transmitted in real time to the corresponding APP for recording through the wireless BLUETOOTH module. When the smart magic cube needs to be recovered, the corresponding instruction is sent through the corresponding APP, and the CPU 412 repeats recorded operations until the smart magic cube is recovered, which realizes smart restoration of the smart magic cube. Each of the recorded operations is recorded in the corresponding APP to improve the fun of the operation of the smart magic cube.

Foregoing descriptions are only optional embodiments of the present disclosure and are not intended to limit the present disclosure. Any modification, equivalent replacement, or improvement within the technical scope of the present disclosure should be included in the protection scope of the present disclosure.

What is claimed is:

1. A smart magic cube with a ball shaft, comprising:

the ball shaft, six center blocks, eight corner blocks fitted with the center blocks, and twelve edge blocks fitted with the corner blocks and the center blocks;

wherein the ball shaft comprises a ball shaft upper cover and a ball shaft lower cover; the ball shaft upper cover and the ball shaft lower cover are hemispherical; the ball shaft lower cover and ball shaft upper cover are assembled into a sphere; an upper fixing mounting seat is arranged in the ball shaft upper cover and a lower fixing mounting seat is arranged in the ball shaft lower cover; a front printed circuit board (PCB), a rear PCB, a left PCB, and a right PCB are embedded between the upper fixing mounting seat and the lower fixing mounting seat; an upper PCB is fixed on the upper fixing mounting seat and a lower PCB is fixed on the lower fixing mounting seat;

wherein the front PCB, the rear PCB, the left PCB, and the right PCB are respectively electrically connected to the upper PCB and lower PCB through connecting plugs; a center processing unit (CPU) is fixedly installed on the lower PCB; a battery is installed between the upper fixing mounting seat and the lower fixing mounting seat; the battery is connected to the upper PCB through a battery conductive sheet; a wireless BLUETOOTH module is installed on the upper PCB; a rotating shaft sensing assembly is arranged on each of the upper PCB, the lower PCB, the front PCB, the rear PCB, the left PCB, and the right PCB; each rotating shaft sensing assembly extends outward to an outer side of the ball shaft lower cover or an outer side of the ball shaft upper cover; each of the center blocks is installed on a corresponding rotating shaft sensing assembly.

2. The smart magic cube with the ball shaft according to claim 1, wherein each rotating shaft sensing assembly comprises a rotating shaft, a rotating shaft sleeve, and a position sensor; each position sensor is correspondingly installed in a position sensor mounting groove; each position sensor mounting groove is defined in a center of the upper PCB, a center of the lower PCB, a center of the front PCB, a center of the rear PCB, a center of the left PCB, or a center of the right PCB; each rotating shaft is fixed on a corresponding PCB through a corresponding rotating shaft sleeve; a bottom end of each rotating shaft is connected to a corresponding position sensor.

3. The smart magic cube with the ball shaft according to claim 2, wherein each of the center blocks comprises a center block seat sleeved on a corresponding rotating shaft; a spring seat is installed in each center block seat; an elastic adjusting spring is sleeved on each rotating shaft; a bottom end of each elastic adjusting spring abuts against a corresponding center block seat; a top end of each elastic adjusting spring abuts against a corresponding spring seat; an elastic gear adjusting block is installed on a top portion of each spring seat; a gear dial is installed on a top portion of each elastic gear adjusting block; each rotating shaft longitudinally passes through a center of a corresponding elastic adjusting spring, a center of a corresponding spring seat, a center of a corresponding elastic gear adjusting block, and a center of a corresponding gear dial, and is clamped with the corresponding gear dial; a top cover covers a top portion of each center block seat.

4. The smart magic cube with the ball shaft according to claim 3, wherein each of the corner blocks comprises a corner block seat; three corner block magnetic bins are evenly arranged on sides of each corner block seat; a first magnet is installed in each of the corner block magnetic bins, a top portion of each corner block seat is sealed by three corner block pressing covers connected with each other.

5. The smart magic cube with the ball shaft according to claim 4, wherein each of the edge blocks comprises an edge block seat; two edge block magnetic bins are symmetrically arranged on two sides of each edge block seat; a second magnet is installed in each of the edge block magnetic bins; a top portion of each edge block seat is sealed by two edge block pressing covers; the two edge block pressing covers are connected with each other.

6. The smart magic cube with the ball shaft according to claim 1, wherein the ball shaft lower cover comprises a lower cover body in a hemispherical shape, a bottom rotating shaft hole is defined on a bottom portion of the lower cover body; four side rotating shaft lower half holes are defined on a top end of the lower cover body; a plurality of screw posts is defined on the lower cover body.

7. The smart magic cube with the ball shaft according to claim 6, wherein the ball shaft upper cover comprises a upper cover body in a hemispherical shape; a top rotating shaft hole is defined on a top portion of the upper cover body; four side rotating shaft upper half holes are defined on a bottom end of the upper cover body; the four side rotating shaft upper half holes are matched with the four side rotating shaft lower half holes; screw grooves are defined on an outer surface of the upper cover body; each of the screw grooves defines a docking screw hole matching a corresponding screw post defined on the lower cover body; each docking screw hole is connected with each of the screw posts through a screw to connect the ball shaft upper cover with the ball shaft lower cover.

* * * * *